US006022816A

United States Patent [19]

Dewar

[11] Patent Number: 6,022,816

[45] **Date of Patent: *Feb. 8, 2000**

[54] CLOSURE

[75] Inventor: George Galloway Dewar, Cremorne, Australia

[73] Assignee: Dewco Investments Pty Ltd., Dee Why, Australia

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/889,207

[22] Filed: Jul. 7, 1997

Related U.S. Application Data

[63] Continuation-in-part of application No. 08/406,149, Mar. 20, 1995, Pat. No. 5,665,462.

[30] Foreign Application Priority Data

| | | | |
|---|---|---|---|
| Mar. 18, 1994 | [AU] | Australia | PN 4852 |
| Aug. 29, 1994 | [AU] | Australia | PN 7741 |

[51] Int. Cl.[7] ..... B32B 05/02; B32B 29/00

[52] U.S. Cl. ..... 442/104; 442/152; 442/154; 442/155; 442/157; 442/159; 442/164; 442/165; 442/167; 442/169; 442/170; 442/321; 442/324; 442/405

[58] Field of Search ..... 442/104, 152, 442/154, 155, 157, 159, 164, 165, 167, 169, 170, 321, 324, 405

[56] References Cited

U.S. PATENT DOCUMENTS

| | | |
|---|---|---|
| 926,895 | 7/1909 | Quillot . |
| 1,463,570 | 7/1923 | Bragdon . |
| 1,466,113 | 8/1923 | Bragdon . |
| 1,763,129 | 6/1930 | Broadhurst . |
| 3,772,136 | 11/1973 | Workman . |
| 3,874,541 | 4/1975 | Lagneaux et al. . |
| 4,081,884 | 4/1978 | Johst et al. . |
| 4,091,136 | 5/1978 | O'Brien et al. . |
| 4,176,095 | 11/1979 | Aziz et al. . |
| 4,182,458 | 1/1980 | Meckler . |
| 4,349,122 | 9/1982 | Klar et al. . |
| 5,052,578 | 10/1991 | Goodwin . |
| 5,229,439 | 7/1993 | Gueret . |

FOREIGN PATENT DOCUMENTS

| | | |
|---|---|---|
| 32453/78 | 7/1979 | Australia . |
| 15912/88 | 11/1988 | Australia . |
| 291802 | 7/1971 | Austria . |
| 331392 | 4/1903 | France . |
| 1508722 | 11/1967 | France . |
| 1518450 | 2/1968 | France . |
| 168705 | 1/1905 | Germany . |
| 178740 | 12/1905 | Germany . |
| 6909984 | 1/1970 | Netherlands . |
| 211675 | 2/1923 | United Kingdom . |
| 458227 | 5/1936 | United Kingdom . |
| 557937 | 6/1942 | United Kingdom . |
| 2093054 | 8/1982 | United Kingdom . |

OTHER PUBLICATIONS

Wool Science Review 61, International Wood Secretariat, Development Centre, pp. 3–58 "A Winery Evaluates Synthetic Cork," Tom Mackey, Wines and Vines, Jul. 1992.
ISO 9729, 1991.
ISO 3863.
ISO 9727, 1991.

*Primary Examiner*—Helen L. Pezzuto
*Attorney, Agent, or Firm*—McDermott, Will & Emery

[57] ABSTRACT

A closure for a container having an opening, said closure comprising at least one resilient mass of fibers selected from synthetic fibers, natural fibers and mixtures thereof, said at least one resilient mass of fibers having a density in the range of 0.15 to 2.00 g/cm$^3$ and having one of an interlocked structure, an associated structure and a combination thereof, and wherein the closure is sized and has a density to enable the closure to be sealingly inserted into the opening of said container.

20 Claims, 4 Drawing Sheets

CLOSURE

This application is a continuation-in-part of U.S. patent application Ser. No. 08/406,149, filed Mar. 20, 1995, now U.S. Pat. No. 5,665,462 entitled CLOSURE.

FIELD OF THE INVENTION

This invention relates to closures for containers, particularly wine bottles, and to methods for making same.

BACKGROUND OF THE INVENTION

Wine bottle closures made from natural cork can be a source of chemicals which may produce mouldy taints in the contents of the bottle. These chemicals (such as trichloroanisoles) may originate from the bleaching process used for cork which involves treatment with chlorine or other chloro compounds. Wine which has been exposed to such chemicals is described as being "corked", and it has been estimated that the wine in up to 10% of all bottles of wine sold worldwide may be corked in this manner. Further, cork is becoming an increasingly scarce commodity and is now so expensive that some winemakers have resorted to the use of corks made from agglomerated particles of recycled cork. These so-called "agglo" corks have also been shown to taint wine, probably, in part, as a result of the adhesive used.

Consequently, there is a great need for inexpensive alternatives to cork bottle closures. Two such alternatives are plastic "champagne-style" corks and metal screw-cap "Stelvin" closures. Whilst these types of closures produce an excellent seal, their use has been limited to low grade wines due to their poor aesthetic qualities.

It is now proposed that closures comprising synthetic and/or natural fibres, particularly wool, would be an excellent alternative to cork.

SUMMARY OF THE INVENTION

Accordingly, the present invention provides a closure for a container having an opening, said closure comprising at least one resilient mass of fibres selected from synthetic fibres, natural fibres and mixtures thereof, said at least one resilient mass of fibres having a density in the range of 0.15 to 2.00 g/cm$^3$ and having one of an interlocked structure, an associated structure and a combination thereof, and wherein the closure is sized and has a density to enable the closure to be sealingly inserted into the opening of said container.

DETAILED DESCRIPTION OF THE INVENTION

The present invention provides a container closure comprising at least one resilient mass of fibres selected from synthetic fibres, natural fibres and mixtures thereof. The at least one resilient mass of fibres has a density in the range of 0.15 to 2.00 g/cm$^3$ and has one of an interlocked structure, an associated structure or a combination thereof.

By the term "fibres" we refer to materials that may be formed into a yarn, textile, carpet or the like.

Interlocking of fibres may be achieved by, for example, "felting" processes, needle-punching, weaving and/or knitting.

By the use of the term "associated structure" we refer to other structures providing a resilient mass of fibres. Such structures may be prepared by, for example, bonding the fibres, or a portion of the fibres, with an adhesive or polymer(s) having adhesive-like qualities. One particular method envisaged involves melting a polymer(s) present in a fibre-polymer(s) mix such that the polymer(s) bonds to the fibres (i.e. upon cooling). In this way, a network of fibres can be produced with a level of resilience suitable for closures that are intended to be inserted and extracted from an opening in a container. Preferred meltable polymers for use in producing a resilient mass of fibres having an associated structure include polyesters, particularly low melting point polyesters. The meltable polymer may comprise 5 . 95% by weight, preferably 20–40% by weight, of the resilient mass of fibres. Varying the ratio of the amount of meltable polymer to fibres enables the production of resilient masses of bonded fibres to be produced with a range of densities. A method for bonding wool fibre in this manner is described in Australian patent specification No. 15912/88, the disclosure of which is incorporated herein in its entirety by reference.

The fibres, or a portion of the fibres, may also be present in the form of bonded "felted yarns" or "felted slivers".

Preferred natural fibers include vegetable fibres such as cotton, flax, sisal, linen, cellulose and jute, and animal-derived fibres such as angora, wool, alpaca and mixtures thereof.

Preferred synthetic fibres include cellulose acetate, cellulose triacetate, acrylics, aramids (i.e. aromatic polyamides), rayons, polyolefins (e.g. polypropylene), nylons, polyesters, polyurethanes, terylenes, teflon and mixtures thereof.

Mixtures of the abovementioned synthetic and/or natural fibres may also be suitable. Most preferably, the fibres are sheep wool or fibre mixtures including sheep wool fibres.

Preferably, the resilient mass of fibres has a density in the range of 0.18 to 0.95 g/cm$^3$, more preferably, in the range of 0.35 to 0.45 g/cm$^3$.

Closures according to the invention may further comprise one or more coating and/or impregnating additives which may be added, for example, to vary the resilience or density of the fibre mass; to vary the sealing properties of the closure; and/or assist insertion or extraction of the closure. The coating and/or impregnating additives may also be added in order to isolate the fibre mass from the contents of the container.

Accordingly, the fibres comprising the resilient mass and/or the outside of the closure may be coated, wholly or partially (e.g. the ends of the closure only), with a coating material such that the contents of the container do not directly contact fibres. Alternatively, the coating materials could be used to fill part or all of the interfibre spaces (i.e. impregnants) in the closure. Where the contents of the container is a food or beverage, the coating and/or impregnant material would preferably be selected from those which are "food-contact approved". As a further safety measure in food and beverage applications, the mass of fibres would also, preferably, be sterilised.

Suitable coatings include those typically used in packaging materials such as polyethylene dispersions, modified polyethylene dispersions and gels of polymers such as ethylene vinyl copolymer (EVA), solutions and dispersions of poly(vinylidene chloride) and its copolymers (e.g. foamed and non-foam PVC), polyurethanes, natural synthetic rubbers such as ethyl propylene diene rubber (EPDM), acrylic latexes, lacquers and dispersions and various thermoformed films. Paraffins, waxes and silicones may also be suitable coating additives.

The closures may also have more than one coating, each coating being the same or different in composition. It is also to be understood that an impregnant may be used in conjunction with one or more coatings. Including multiple coatings (particularly of wax), may assist in the production of closures having a more uniformly smooth surface (which may enhance the sealing qualities of the closure). Harder coatings such as some PVDC's and hard acrylics may also be machined using a polishing brush or the like to provide a smooth surface. Alternatively, a smooth finish may be achieved by placing the freshly coated fibre mass into a mould and curing the coating additive(s) within the mould.

The coating and/or impregnating additive(s) may comprise 0.01–70% (by weight) of the closure, more preferably 0.1–30% (by weight). Where the additive(s) impregnate the fibres of the fibre mass, it is preferred that they comprise 1–30% (by weight) of the fibre mass.

To incorporate or apply coating and/or impregnating additive(s) to the fibre mass, it may be necessary to dry (e.g. by microwave or hot air tumbling) or pre-treat the fibre mass to improve adhesion or incorporation. Where the fibre mass is a wool fibre mass, the pre-treatment(s) may be selected from chlorine treatment, UV treatment and other oxidising treatments such as treatment with sulphuric acid, zinc acetate and hydrogen peroxide.

The coating and/or impregnating additives may be applied or incorporated into the fibre mass by dipping, spraying and/or injecting. Alternatively, individual fibres or bundles of fibres may be coated and then formed into a resilient mass of interlocked and/or otherwise associated fibres.

Preferably, any coating and/or impregnating additives should not greatly affect the resilience of the fibre mass. Thus, the preferred coating and/or impregnating additives are PVC's and polyurethanes, particularly when applied as coatings to the outside of the fibre mass, as these additives are particularly good at preserving the resilience of the fibres in the fiber mass. The PVC's also show low friction qualities which can assist in the insertion and extract on the closure from the opening of a container. These low friction qualities may also be varied by adjusting the amount and/or kind or plasticisers used or extenders (in the case of polyurethane).

Closures according to the invention may also be provided with end caps of coating additive(s), that is caps of about 0.5 to 5.00 mm thick on one or both ends of the closure. Alternatively, and more preferably, closures according to the invention may be provided with end caps composed of an end portion of the fibre mass(es) impregnated with an impregnating additive(s). The impregnated end portion of the fibre mass(es) may be 0.1 to 5.0 mm thick. These caps of coating and impregnating additive(s) may provide structural integrity and avoid any distortion of the closure upon insertion into an opening.

The closures according to the invention may also include more than one mass of fibres. In such embodiments the fibre masses may be bonded together with an adhesive and may have the same or different characteristics. That is, they may, for example, have different densities, different coating and/or impregnating additives to be produced in different manners. One fibre mass may be impermeable to liquids, whilst another may be impermeable to gaseous molecules. Fibre masses may also be bonded to and separated from each other by one or more liquid and/or gas-impermeable membranes. The membranes may also extend to a slightly larger diameter than the fibre mass in order to assist in forming (or entirely form) the seal between the closure and the surface of the container's opening, with the fibre mass providing the necessary compression force.

In addition, due to the resilience of the fibre mass(es), the closures according to the invention may not necessarily resemble a shape which mirrors the opening to be sealed. For instance, a closure for a wine bottle may, preferably, have the shape and dimensions similar to standard cork closures with or without curved ends (concave or convex) but may also be spheroid or ovoid. The closure may also comprise a fibre mass having the standard shape of a cork closure but provided with O-rings formed of rubber or other resilient polymer. The O-rings would thus assist in forming (or entirely form) the seal between the closure and the bottle neck, with the fibre mass providing the necessary compression force. Some of the envisaged shapes and constructions of closures for wine bottles are depicted at FIG. 1.

In order to meet the sealing requirements for the broadest range of containers/contents, and particularly for application in the wine and spirit industry, it is preferred that the closure is substantially impermeable to liquids and gases.

Closures according to the invention may be formed in several manners. One method is by conventional felting of the fibres in sheet form, followed by "punching-out" or cutting out (e.g. using a rotating cutting instrument) of wads of fibres for use as, or in, closures.

Conventional felting and various treatments and pre-treatments for felt are reviewed in Wool Science Review 81 (International Wool Secretariat Development Centre, Valley Drive, Ilkley, Yorks), the disclosure of which is incorporated herein by reference.

Thus, in a further aspect, the invention provides a method for producing a closure of a size and density to enable the closure to be sealingly inserted into an opening of a container, comprising punching-out or cutting out a form from a resilient sheet of synthetic fibres, natural fibres and mixtures thereof having a density in the range of 0.15 to 2.00 $g/cm^3$ and having one of an interlocked structure, an associated structure and a combination thereof.

The "form" may be suitable for use as a closure, or coating and/or impregnating additives may be added to the form to produce a closure.

Preferably, the resilient sheet of fibres is a sheet of felted fibres, particularly felted wool fibres. The "forms" may be punched out or cut out of sheets of wool felt either through the top or bottom of the sheet or through the ends or sides of the sheet. Punching or cutting the forms from the ends of the sheet should provide forms wherein the fibres predominantly lie in a direction substantially parallel to the longitudinal direction of the form. This orientation of most of the fibres may positively affect the resilient qualities of the form.

Coating and/or impregnating additives as described above, may be added during the production of the felt sheet or following the punching-out or cutting out of the form.

Alternatively, closures according to the invention or suitable forms of a resilient mass of synthetic and/or natural fibres, may be produced by extrusion, for example through a die by means of a single-screw or twin-screw extruder.

Thus, in a yet further aspect, the invention provides a method for producing a closure of a size and density to enable the closure to be sealingly inserted into an opening of a container, comprising extruding through a die a resilient mass of synthetic fibres, natural fibres and mixtures thereof having a density in the range of 0.15 to 2.00 $g/cm^3$ and having one of an interlocked structure, an associated structure and a combination thereof, and which resilient mass may be subsequently cut into a form.

Again, the "form" may be suitable for use as a closure, or coating and/or impregnating additives may be added to the form to produce a closure.

In such a method, coating and/or impregnating additives may be added during the production of the resilient mass of fibres or following cutting of the resilient mass of fibres. It is also envisaged that the mass of fibres may be extruded into a length having a "daisy flower" or "honeycomb" cross-section which may subsequently be extruded in the presence of impregnating additives (which may be presented in the form of a gas or solution) through a second circular die of smaller cross-section. In this manner, impregnating additives will be incorporated into the mass at the spaces between the fibres.

Closures according to the invention may also be formed by bonding particulate felt sheet in a suitably shaped mould.

Further, as mentioned above, closures according to the invention may comprise at least one resilient mass of fibres having an associated structure produced by melting polymer (s) in a fibre-polymer(s) mix. Meltable fibre-polymer(s) mixtures may be formed, for example, by extrusion into a cylindrical shape prior to heating. During or following heating, the cylindrical form may be compressed, if desired, to a suitable density. The cooled cylindrical form may then be cut into suitable closure shapes.

Thus, in a still further aspect, the present invention provides a method for producing a closure of a size and density to enable the closure to be sealingly inserted into an opening of a container, the method comprising preparing a mixture of meltable polymer(s) and fibres selected from synthetic fibres, natural fibres and mixtures thereof, forming the mixture into a substantially cylindrical form, heating said substantially cylindrical form so as to melt the meltable polymer(s), and allowing said substantially cylindrical form to cool.

Closures according to the invention may be readily adapted to be suitable for sealing openings in many different kinds of container. However, the closures are primarily intended for use in the wine and spirit industry, and particularly for sealing wine barrels and wine bottles. The closures are hereinafter described in respect to their use in sealing wine bottles.

It is believed that wool closures would have considerable appeal to winemakers and drinkers alike for several reasons. That is:

Wool is relatively inexpensive and widely available.

Wool is a natural product with a pleasant appearance.

When interlocked (e.g. felted) or provided with an associated structure, it has been found that wool fibres within a closure retain sufficient resilience to prevent compression set of the closure upon insertion into the neck of a bottle. This enables wool closure to provide a satisfactory seal.

Wood closures according to the invention may be inserted into the neck of a bottle using standard corking machines. They may also be extracted using an ordinary cork screw.

When wool fibres are used, it is preferable that they are from scoured, unspun wool. Wool fibres that have been subjected to further cleaning processes (e.g., carding and combing) are likely to require lesser volumes of any desired additives, however the use of such fibres may result in the loss of some of the rustic appeal of the closure. Alternatively, clean vegetable matter such as wood chips and/or splinters (especially oak chips and/or splinters of 0.5 to 4 mm in length) may be added to clean wool to provide a rustic "freckled" appearance. Further, clean wool may be readily dyed with food-approved colourants to restore a rustic appearance to the closure. Food-approved colourants may also be used to give the closures a colour resembling that of cork closures.

In preliminary taint testing trails of felted wool, using neutral dry white wine, olfactory taints caused by the wool were sometimes detected. This tainting can be avoided by isolating the wool fibres through the use of a coating and/or impregnating additive(s) as described above. However, as a further precaution, it is preferred that the wool fibres be subjected (either before, during or after formation into a resilient mass) to a taint removing or altering process. Such processes include treatments such as those described above for improving adhesion or incorporation of coating and/or impregnating additives; particularly, treatment with sulphuric acid (up to 10 wt %), zinc acetate (11.5 wt %) and hydrogen peroxide. Other suitable processes for taint removal or alteration may include treatment with acetic acid (10 wt %), ammonia solutions (2.5 wt %), sodium bicarbonate (25 wt %), ammonium persulphate, persulfuric acid, and processes involving evacuation and steam.

It has been found that in order to achieve good sealing qualities, wool closures for use with wine bottles should preferably comprise at least one resilient mass of felted wool coated with one or more relatively soft coating additives. Coatings of a soft polyurethane such as the food-contact approved polyurethane 6012A (UniRoyal Chemical Co.) are particularly suitable, especially when used with an undercoat of ethylene vinyl acetate (EVA) copolymer. Soft locating materials do, however, tend to increase the insertion and extraction forces required and, thus, use of an outer coating of a lubricant material such as a paraffin, wax or silicone is preferred. One particularly suitable lubricant coating additive is the silicone product Gensil (Rhone-Poulenc).

Accordingly, wool closures for use with wine bottles preferably comprise at least one resilient mass of felted wool fibres, said mass coated in;

a first, inner, layer of a coating additive selected from ethylene vinyl acetate copolymer natural latex, poly vinyl alcohol (PVA), poly vinyl hydroxyl (PVOH), styrene-butadiene and acrylics.

a second, intermediate, layer of an impregnating agent selected from polyurethane natural latex and silicones, and a third, outer, layer of a lubricant material.

Optionally, the wool closure may include a cap on the end of the closure that is intended to face the wine, composed of an end portion of the fibre mass(es) impregnated with an impregnating additive(s). Preferably, the impregnating additive(s) is the same impregnating additive(s) as that used in the said intermediate layer.

Such end caps may be prepared by placing the wool fibre mass to be capped into an evacuation mould (either before or after coating by, for example, brushing or dipping), immersing the mould holding the wool fibre mass into a reservoir of a suitable impregnating additive(s) and drawing the additive(s) into the end portion(s) of the wool fibre mass by application of a vacuum. Subsequently, the mould holding the wool fibre mass is removed from the reservoir and vacuum line, and the impregnating additive(s) allowed to cure (e.g. by heating in an oven) before the capped fibre mass is removed from the mould. The process (for producing caps at both ends of a substantially cylindrical fibre mass) is shown schematically at FIG. 3. The process effectively produces a cap(s) of a fibre-impregnating additive(s) composite. Formation of the composite cap(s) can be controlled by mould design, evacuation conditions, temperature and viscosity of the polymer in the reservoir. The evacuation mould may also be adapted to form composite edges on all faces of the wool fibre mass.

Wool closures for use with wine bottles also preferably comprise a single resilient mass of wool fibres included, preferably having a shape and dimension similar to a standard cork closure, that is, of substantially cylindrical shape of 24 to 55 m length and 17 to 28 mm (more preferably, 21 to 23 mm) diameter. The use of a single substantially cylindrical mass with a diameter of 21 to 23 mm requires only very thin coats of additives to be applied (e.g. 0.05 to 1.00 mm), otherwise the insertion and extraction forces shall be unacceptable.

The invention shall now be further described with reference to the following non-limiting examples and accompanying drawings.

EXAMPLE 1

Preparation of Closures

MATERIALS AND METHODS

Preparation of Wads (fibre masses)

Cylindrical wad forms were cut from wool felt sheet of density 0.35 g/cm$^3$ (manufactured by P&F Filtration Ltd, Australia), 0.40 g/cm$^3$ and 0.45 g/cm$^3$ (manufactured by Bury Cooper and Whitehead Ltd, U.K.). Cutting was performed by rotating cutting instrument or by forcing a steel punch of chosen internal diameter in a mechanical press through the felt. The speed of cutting was slow enough to allow the wad to remain uncompressed. Excessive speed cutting speed tended to cause concave sides on the wad. The wads had diameters of 17 mm, 18 mm, 21.5 mm, 22 mm, 22.5 mm, 25 mm or 28 mm and were 27 mm, 28 mm, 38 mm or 43 mm in length when cut out of the felt. When creasing of certain coated wads of 28 mm diameter was observed to prevent an adequate seal to the bottle neck; the wads of smaller diameter were used.

Impregnation of Wads (1)

The wads were weighed and placed in the appropriate impregnating liquid either in a beaker held in a desiccator, or in a Quickfit standard taper (Female, B24) ground glass fitting. The wad in the beaker was impregnated by exhaustion of air from the desiccator using the vacuum generating by a water tap aspirator. The wad sank into the impregnating medium when the air was removed. The desiccator was removed from the vacuum source, opened and the wad removed and weighed before drying. When the impregnating liquid was sucked through the wad the vacuum source was removed and the wad was weighed before and after drying. In some cases, the wad was inverted and the impregnating liquid passed through again. Wads from both treatments were typically dried in a microwave oven at 202 watts for 4 minutes.

Impregnation of Wads (2)

Figure 3:
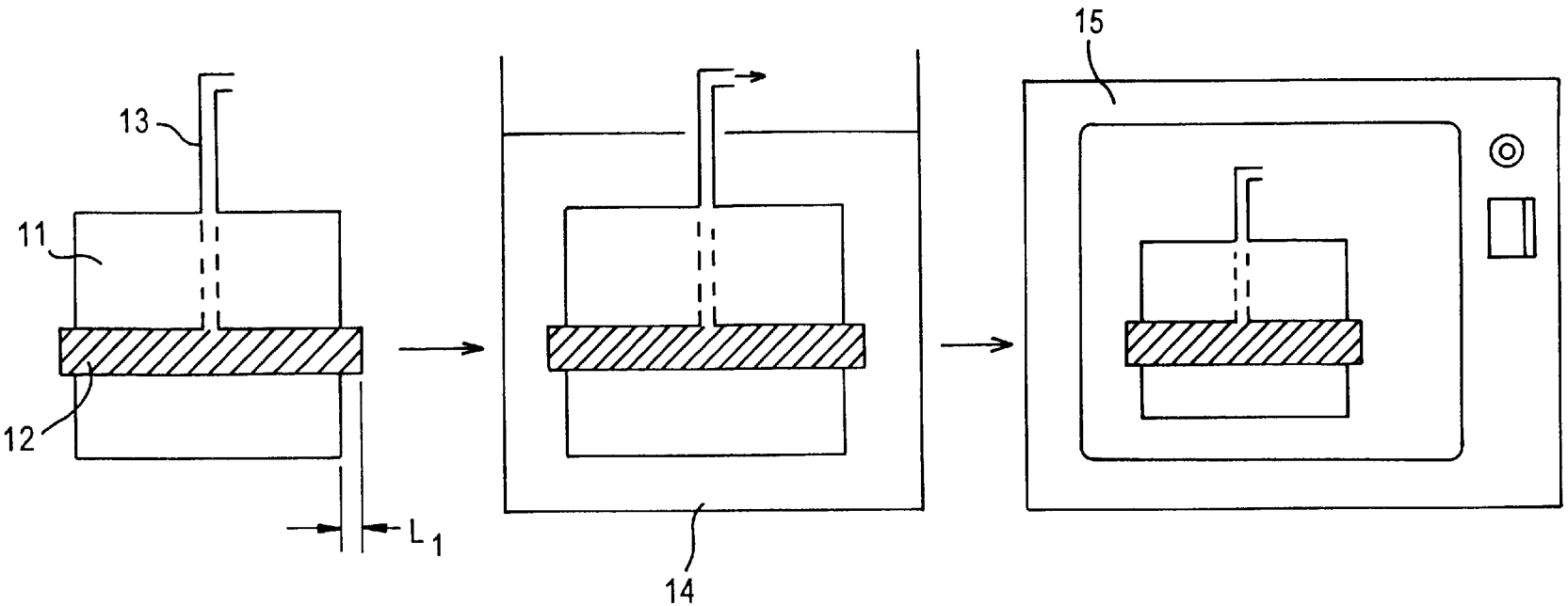
FIG. 3 provides a schematic plan of a process for forming composite end caps on substantially cylindrical masses of fibres. An evacuation mould (1) holding a fibre mass (12) in a manner such that the end portions of the fibre mass are exposed ($L_1$ is typically 1–4 mm) is placed in a reservoir (14) of a suitable impregnating additive(s) and a vacuum briefly applied through vacuum line (13). The mould holding the impregnated fibre mass is subsequently removed from the reservoir. The impregnating additive(s) is/are cured in an oven (15) before removing the capped fibre mass from the mould.

The closures of examples 51–57 were provided with composite end caps of fibres and impregnating polyurethane 6012A. Such end caps were produced according to the process depicted in FIG. 3. In particular, wads of 21.5 mm and 22.0 mm diameter and thickness (length) of 38 mm and 43 mm were placed in a mould (11) with a horizontal bore of internal diameter of 21.0 mm, 21.5 mm or 22.0 mm. The wads when placed in the mould have exposed overhang end portions of $L_1$ of about 1–4 mm. The mould holding the wad was placed in a reservoir of polyurethane 6012A at >50° C. (preferably, 80–100° C.) and a vacuum applied for about 1–4 seconds through vacuum lines (13). Curing was subsequently achieved in an oven before removing the capped wad from the mould.

Coatings (1) Wax and silicone coatings.

Wax or silicone coatings were applied by dipping the wads into the coating agent with the aid of tweezers. Wax coating weights were controlled by control of the temperature of the wax with lower coating weights being obtained at higher temperatures.

(2) PVC Plastisol Coatings.

Two PVC plastisols were used initially. The first, W.R. Grace AD07-2126.3 does not foam when heated to 180° C. for 5 minutes. The second, Daraseal 700 (Sicpa), foams under these conditions. The coating was achieved by first pouring plastisol, (5 g for 28 mm was length, 7 g for 48 mm wad length) into a cylindrical aluminium mould, 48 mm deep with an internal diameter of 20 mm. A wad of 18 mm (non-foaming plastisol) or 17 mm (foaming plastisol) diameter was then lowered carefully into the mould to within 4 mm of the bottom. The wad was held by means of a screw hook inserted into the top of the wad and the wad was slowly turned to assist in the distribution of the plastisol. The mould and its contents was then heated in a fast-recovery oven at (180° C. for non-foaming and 200° C. for foaming) for 5 minutes, followed by cooling before removal of the coated wad. The base of the mould was unscrewed and the wad removed. When the non-foaming PVC was used the coated wad had a PVC layer approximately 1 mm thick around the diameter and 2 mm thick at the bottom. When the foamable plastisol was used the foam layer was approximately 1.5 mm thick at the sides and 3–4 mm thick at the bottom.

The non-foaming plastisol is essentially transparent and light pink in colour so that the felt can be seen inside the coating. The foam layer is white and opaque.

(3) Latex Coatings.

A curtain rod hook was inserted into the end of the wad, which was then dipped into latex (from various suppliers: Morton, Michelman, B.A.S.F., Dragon Chemicals and Dussek Campbell) leaving the top uncoated. The wad was removed and placed immediately into a fast recovery oven at 105° C. for five minutes, then re-immersed in the latex and placed in a fast recovery oven at 95° C. for five minutes.

(4) Thermoformed Skin Coatings.

Wads of 22 mm diameter and thickness of 28 mm were covered with a commercial laminating adhesive (Lamal, Coates Bros, Sydney) and tightly packed to approximately half their thickness by thermoforming a skin of Surlyn (Du Pont plastics) ionomer film around them on a commercial blister packing machine. The film did not form a crease-free skin beyond half the thickness of the film. A wad was tested for its effectiveness in preventing liquid loss from a bottle of wine simulant after insertion into the bottle with the skin-covered end towards the wine simulant. The use of tubular forms of thermoformed skin should avoid creasing problems. The ends of a closure enclosed in a tubular thermoformed skin may be dipped in sealing plastic.

(5) Polyurethane Coatings.

Wads of 21.5 mm and 22.5 mm diameter and thickness (length) of 38 mm and 43 mm were dried in an evacuation oven at about 110° C. (−1 atm) for 1 hour then coated by dipping or brushing with polyurethane 6012A (UniRoyal Chemical Co.). The freshly coated wads were then placed in a mould having an internal bore diameter of 21.0 or 21.5 mm and then the polyurethane was cured. In some cases, an EVA undercoat was first applied before coating with polyurethane.

Two-part closures with a membrane in between

Wads were cut in halves to give two wads of thickness approximately 14 mm each. These were combined to give a single wad by means of a circular piece of double-sided adhesive tape based on a film of polypropylene. This type of wad was found to break easily due to inadequate cohesion. Wads impregnated with an acrylic emulsion were used and found to have adequate cohesion to allow insertion into the bottles but the seal against the glass at the top joint was not found to be satisfactory for wine applications.

Three-part closures

Three wads of 22 mm diameter were taken and two were skin packed with Surlyn in one case and Primacor (ethylene acrylic acid copolymer) in the other. These two wads were then cut in halves by means of a Stanley Knife and the unsealed end was discarded in each case. Half of the third wad was impregnated with Michelman Prime 4990R emulsion of ethylene acrylic acid copolymer to give some additional adhesion to the bottle neck. The latter half-wad was placed between the other two wads with the double-sided tape as adhesive. The wad inserted into the wine simulant using a hand corking machine and the Surlyn-skinned end wad towards the outside of the bottle.

EXAMPLE 2–36

Wool Felt-Latex Closures

All closure examples 1–35 were made using wads of 0.35 g/cm$^3$ woo felt. The felt wads used in the closures of Examples 2–22 were 28 mm in diameter, and 27 mm in length. The felt wads used in the closures of Examples 23–28 were also 27 mm in length but varied in diameter as indicated in Table 1.

TABLE 1

| Example No | Latex Name | Type | FDA Compliance | Flet diameter (mm) | Solution Solid % | % Coating | Dry Closure Pull Out Force (kg) 1 day | 2 days | Film Properties |
|---|---|---|---|---|---|---|---|---|---|
| 2 | Glascol C36 | acrylic | unconfirmed | 28 | 2.5 | 11 | 59 | 32 | hard, brittle |
| 3 | Glascol C36 | acrylic | unconfirmed | 28 | 5 | 15 | 40 others | 43 | hard, brittle |
| | | | | | | | push through | 38 | |
| 4 | Glascol C36 | acrylic | unconfirmed | 28 | 10 | 29 | 55 | 61 | hard, brittle |
| | | | | | | | 35 | 86 | |
| 5 | Q-thane | urethane | unconfirmed | 28 | 2.5 | 15 | 26 | 36 | hard, flexible, |
| | | | | | | | 25 | 32 | after 4 days |
| | | | | | | | 23 | | water immersion |
| | | | | | | | | | at room |
| | | | | | | | | | temperature |
| | | | | | | | | | softening |
| | | | | | | | | | and heavy |
| | | | | | | | | | whitening |
| | | | | | | | | | observed |
| 6 | Michhelman X300 | acrylic | 176,170 | 26 | 2.5 | 13 | 21 | 29 | soft, waxy |
| | | | 176,180 | | | | 17 | 20 | |
| 7 | Michelman X300 | acrylic | 176,170 | 28 | 5 | 14 | 23 | 31 | soft, waxy |
| | | | 176,180 | | | | 38 | 32 | |
| 8 | Michelman X300 | acrylic | 176,176 | 28 | 10 | 31 | 33 | 26 | soft, waxy |
| | | | 176,180 | | | | 29 | 38 | |
| | | | | | | | 30 | 36 | |
| 9 | Michelman X300 | acrylic | 176,170 | 28 | 15 | 32 | 30 | — | soft, waxy |
| | | | 176,180 | | | | 37 | | |
| | | | | | | | 29 | | |

TABLE 1-continued

| Example No | Latex Name | Type | FDA Compliance | Flet diameter (mm) | Solution Solid % | % Coating | Dry Closure Pull Out Force (kg) 1 day | 2 days | Film Properties |
|---|---|---|---|---|---|---|---|---|---|
| 10 | Michelman 50A | acrylic | 176,176 | 25 | 2.5 | 16 | 37<br>37<br>41 | 27<br>33<br>31 | Medium hardness, ductile cohesion. After 4 days water immersion at room temperature slight softening and heavy whitening observed |
| 11 | Michelman 66725 | Polyethylene | not approved | 28 | 5 | 17 | 16<br>15<br>15 | 15<br>22<br>20 | soft, waxy |
| 12 | Michelman 48040 | microwax | not approved | 28 | 5 | 15 | 13<br>13 | 14<br>17<br>14 | medium hardness, waxy |
| 13 | BASF 193D | polyvinylidene | unconfirmed | 28 | 5 | 18 | 28<br>30<br>23 | 32<br>23<br>22 | hard, brittle |
| 14 | Michelman 01546 | microwax | unconfirmed | 28 | 5 | 11 | 10<br>18 | 14<br>13<br>10 | very soft, waxy |
| 15 | Michelman 763 | acrylic | 176,180<br>175,350<br>175,3207 | 28 | 5 | 14 | 34<br>35<br>30 | 33<br>37<br>45 | Medium hardness, firm cohesion. After 4 days water immersion at room temperature slight softening and whitening observed |
| 16 | BASF 360D | acrylic | unconfirmed | 28 | 5 | 14 | 40<br>57<br>58 | 46<br>41<br>56<br>55 | Soft and ductile. After 4 days water immersion at room temperature softening and whitening observed |
| 17 | Michelman 240 | polymeric acrylic | unconfirmed | 28 | 5 | 14 | 13 | 15<br>15<br>12 | Medium hardness, waxy |
| 18 | Michelman 124 | microwax | unconfirmed | 28 | 5 | 15 | 10 | 14 | soft, waxy |
| 19 | Michelman 93135 | high density polyethylene | not approved | 28 | 5 | 15 | 19<br>17 | 21<br>22 | medium hardness, flaky |
| 20 | Michelman 40-H H.S. | polymeric acid | 176,170<br>176,180 | 28 | 2.5 | 11 | 17<br>17<br>14 | | soft, low film strength After 4 days water immersion at room temperature slight softening and heavy whitening observed |
| 21 | Michelman P20 | precoat 20 | unconfirmed | 26 | 2.5 | 9 | 18<br>26 | 19<br>16 | Soft medium coherence. After 4 days water immersion at room temperature softening and heavy whitening observed |

TABLE 1-continued

| Example No | Latex Name | Type | FDA Compliance | Flet diameter (mm) | Solution Solid % | % Coating | Dry Closure Pull Out Force (kg) 1 day | 2 days | Film Properties |
|---|---|---|---|---|---|---|---|---|---|
| 22 | Michelman 103D1 | polyethylene (anionic emulsifier) | 176,170 | 28 | 5 | 14 | 14 | — | soft, waxy |
| 23 | Michelman 103D1 | polyethylene (anionic emulsifier) | 176,170 | 25.4 | 5 | 14 | 8<br>6 | — | soft, waxy |
| 24 | Michelman 103D1 | polyethylene (anionic emulsifier) | 176,170 | 22.2 | 5 | 14 | pushed in | | soft, waxy |
| 25 | Michelman 42745 | wax (nonionic emulsifier) | 175,105<br>175,300<br>175,320<br>176,170<br>176,180 | 26 | 5 | 11 | 16<br>21<br>20 | — | firm, waxy |
| 26 | Michelman 42745 | wax (nonionic emulsifier) | 175,105<br>175,300<br>175,320<br>176,170<br>176,180 | 25.4 | 5 | 11 | 11<br>9<br>6 | — | firm, waxy |
| 27 | Michelman 42745 | wax nonionic emulsifier) | 175,105<br>175,300<br>175,320<br>176,170<br>176,180 | 22.2 | 5 | 11 | pushed in | | firm, waxy |
| 28 | Michelman Prime 4990R | ethylene acrylic acid | 177,3100c<br>176,170b<br>176,180<br>175,105<br>175,300b<br>175,320b | 22.2 | 5 | 18 | 7<br>10<br>10 | — | hard, strong |
| 29 | Michelman Prime 4990R | ethylene acrylic acid | 177,3100c<br>176,170b<br>176,180<br>175,105<br>175,300b<br>175,320b | 25.4 | 5 | 16 | 35<br>33<br>25<br>24<br>16<br>25 | — | Hard, firm. After 4 days water immersion at room temperature slight softening observed |
| 30 | Serfene 121 | polyvinylidene chloride | unconfirmed | | | | | | Hard, brittle. After 4 days water immersion at room temperature slight whitening observed |
| 31 | Michelman 368 | wax | unconfirmed | | | | | | medium hardness, waxy |
| 32 | Michelman 160 | carnuaba wax | approved | | | | | | medium hardness, waxy |
| 33 | Michelman 162 | carnuaba wax | approved | | | | | | medium hardness, waxy |
| 34 | BASF S504 | acrylic | unconfirmed | | | | | | medium-soft, ductile cohesion. After 4 days water immersion at room temperature softening and whitening observed |
| 35 | Michelman 40A | acrylic | unconfirmed | | | | | | medium hardness, ductile cohesion |
| 36 | BASF BASOPLAST 400DS | acrylic (low wetout) | unconfirmed | | | | | | hard, brittle |

*average value based on weight changes and accounting for 10% moisture loss on drying Table 1 provides the characteristics for closure Examples 2–36 and results for extraction tests on these examples. Data from duplicate examples are provided in some instances. By way of comparison, standard cork closures typically required an extraction force of 35–40 kg.

The extraction results where the bottle was not filled with liquid provides an indication of the compression forces with time and the interaction of the closure with glass.

The film properties were determined by drying the latex on a petri dish and evaluating dried film by a simple finger nail scratch test.

EXAMPLE 37–44

Effect of Closure Diameter (uncompressed) on Closure Length in Bottle

The effects of varying the diameter of the closure on the length of the closure when inserted into the neck of the bottle was investigated.

Table 2 provides the results for wool felt-based closures under compression in the bottle neck. All wads used in the closure had an initial fibre density of 0.35 g/cm$^3$ and a length of 28 mm.

TABLE 2

| Example | Original diam. (mm) | Pre-Compression Length (mm) | Post-Compression Length (mm) |
|---|---|---|---|
| 37 Untreated wad | 28 | 28–29 | 34 |
| 38 Untreated wad | 25.4 | 27–28 | 30 |
| 39 Untreated wad | 22 | 27 | 30 |
| 40 Untreated wad 0.45 nominal density 30 mm original length | 21 | 31 | |
| 41 Impregnated with 5% Micryl 763 | 22 | 29–30 | 30 |

TABLE 2-continued

| Example | Original diam. (mm) | Pre-Compression Length (mm) | Post-Compression Length (mm) |
|---|---|---|---|
| 42 Impregnated with 5% Micryl 763 | 25.4 | 29–30 | 34 |
| 43 Impregnated with 5% Micryl 763 | 28 | Too hard to insert into bottle | |
| 44 Impregnated with 5% Michelman 4990R | 25.4 | 30 | 31 |

EXAMPLE 45

Oxygen Permeability Tests performed on various closure

Figure 1:
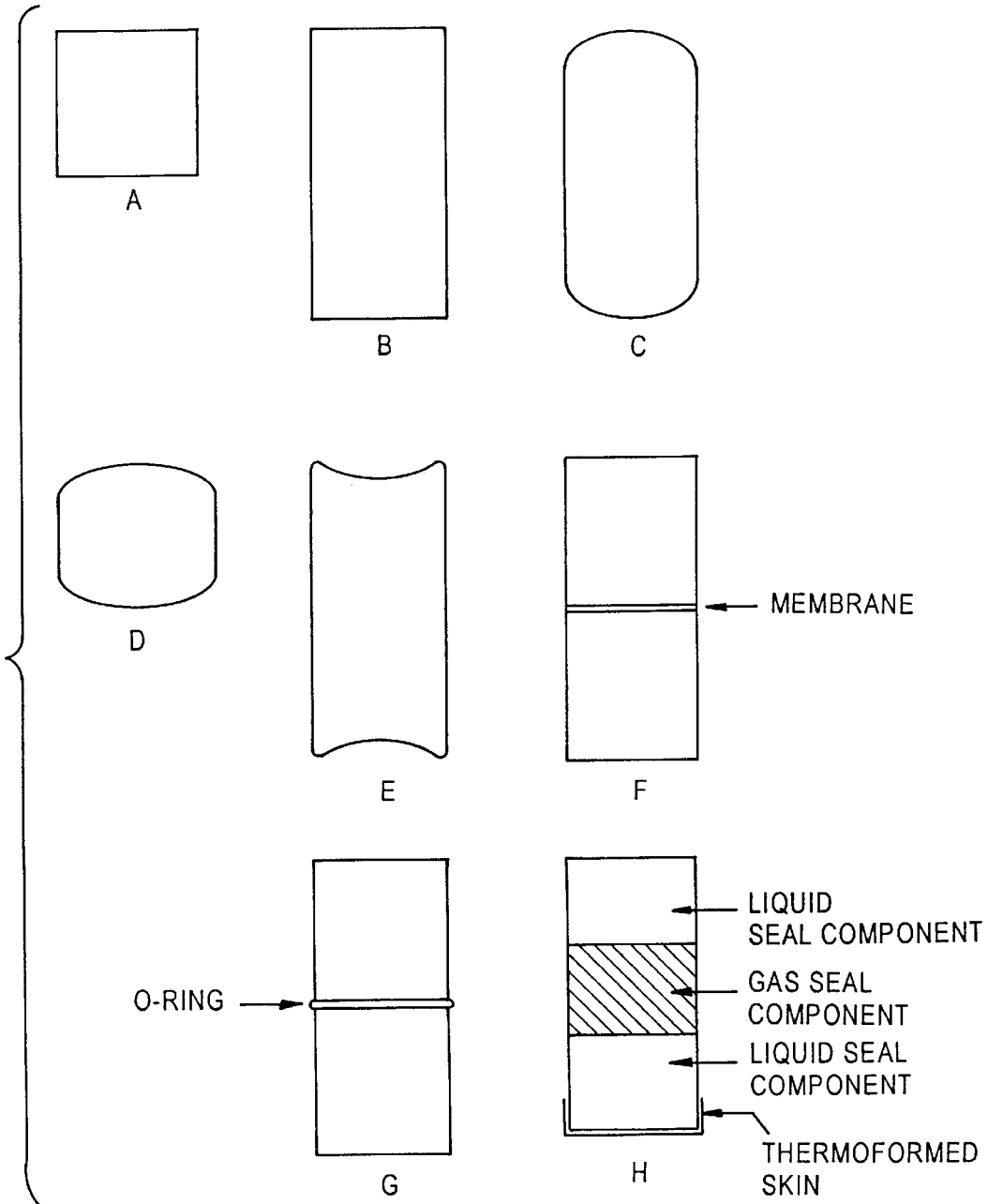
FIG. 1 diagrammatically shows the longitudinal cross-sectional shape and construction of closures according to the invention intended for sealing wine bottles: (A) square, (B) rectangular, (C) rectangular with concave ends, (D) square with concave ends, (E) rectangular with convex ends, (F) two square fibre mass construction including a liquid and gas-impermeable membrane, (G) rectangular with O-ring, (H) three fibre mass construction with thermoformed skin, (I) "barrel", (J) rectangular with "arrow head" flange, (K) rectangular with flaps, (L) rectangular with peripheral O-rings, and (M) rectangular with bevel and (N) rectangular with composite end cap of and end portion of fibres impregnated with an impregnating additive.
Figure 1:
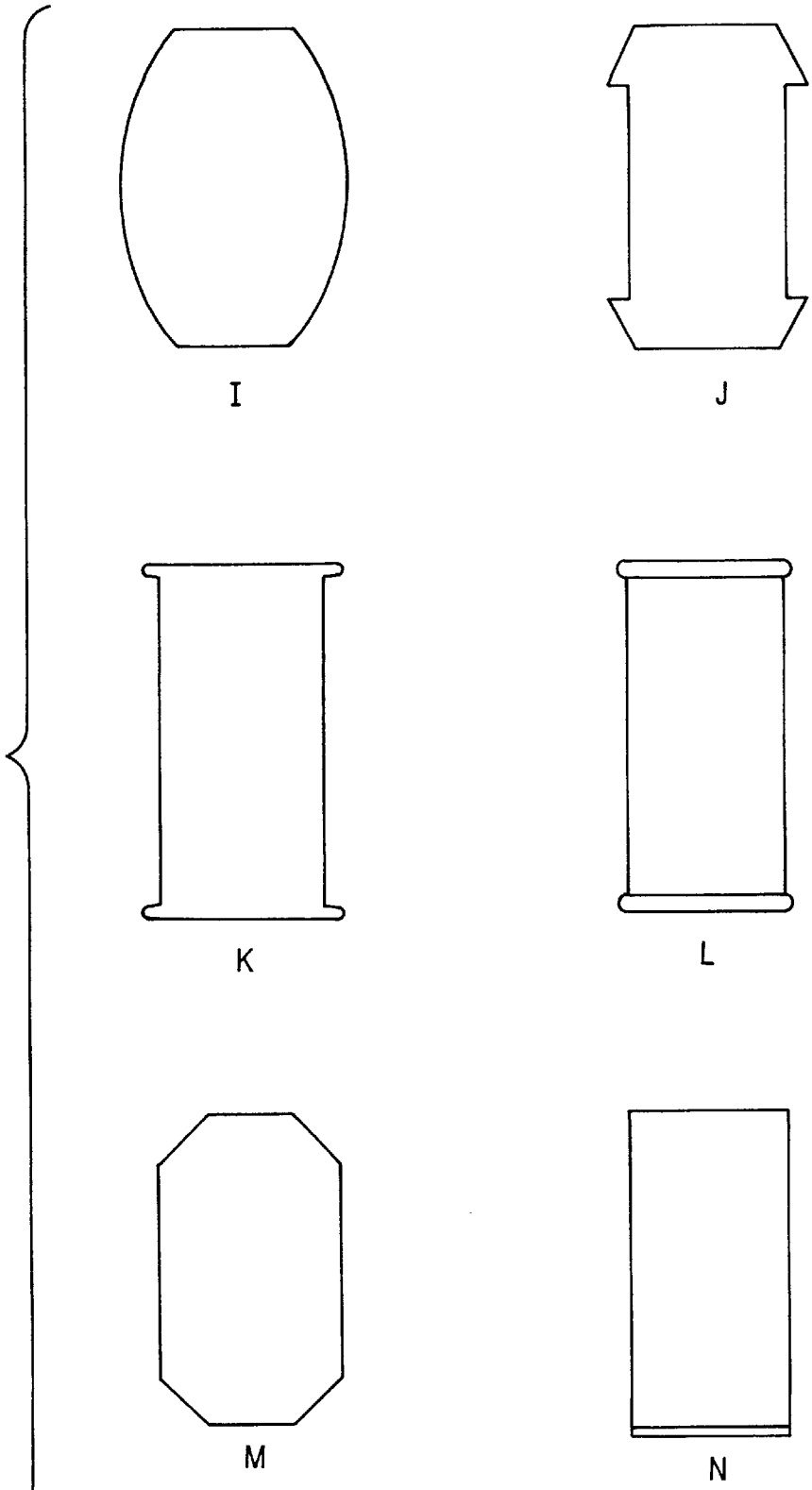
Figure 2A:
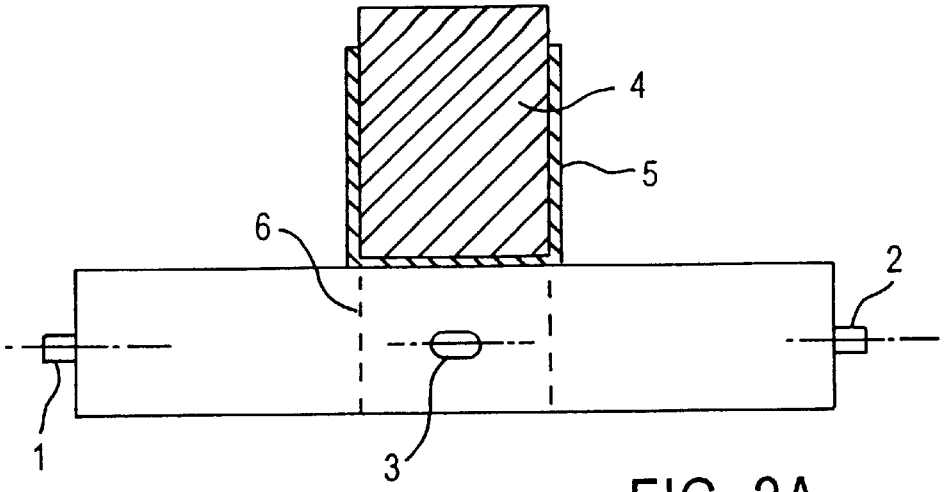
FIG. 2A provides a diagrammatic elevation representation of the test cells used for testing oxygen permeability. The test cell was made from brass, the various ports being ⅛" Swagelock fittings. (1) and (2) are gas flushing ports, (3) is the sampling port, (5) is a tube into which a sample closure (4) is placed, and (6) is a perforated support tube.
Figure 2B:
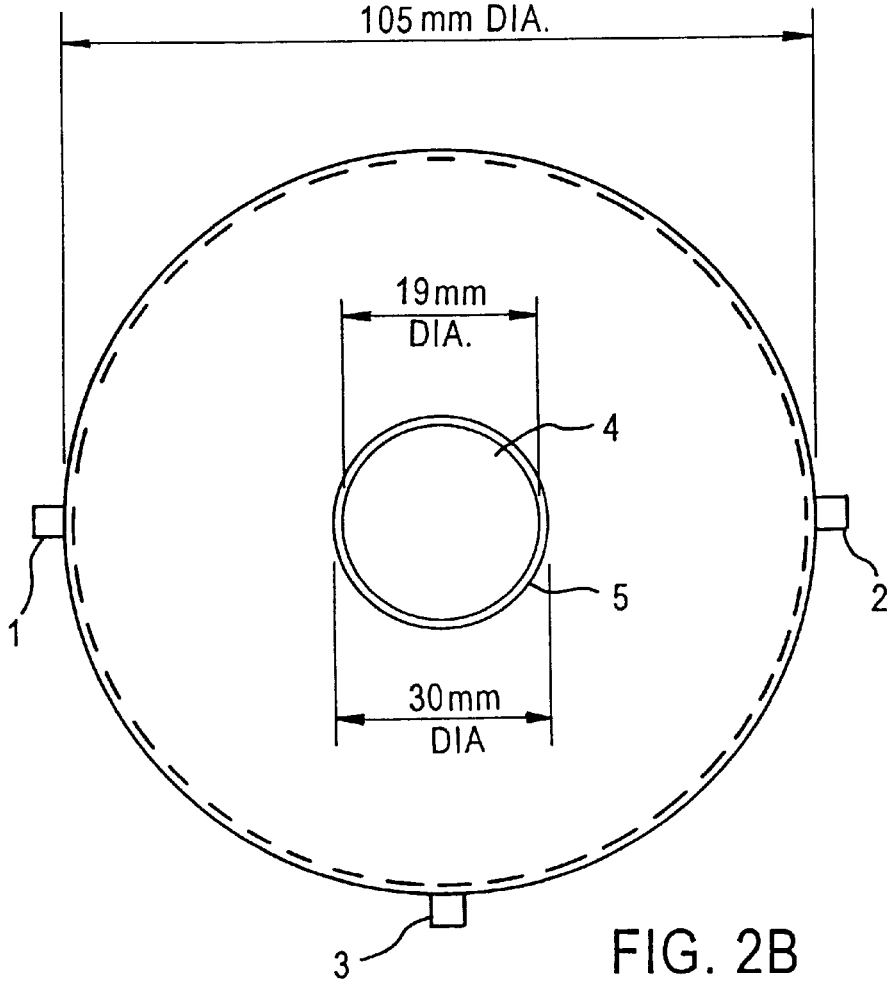
FIG. 2B provides a diagrammatic plan view of the test cells for testing oxygen permeability.

Wool felt-based closures of various construction were tested for oxygen permeability as follows:

Six test cells were constructed from brass as shown in FIG. 2. The top, bottom and cork tube were soldered together, and the joins sealed using Loctite 290 sealant. The gas flushing ports (1) and (2) were sealed using solid ⅛" brass rod. The gas sampling port (3) was sealed using a silicone rubber septum.

The closure sample (4) was loaded into the top tube (5) using a cork inserter. Both gas flushing port caps were removed and nitrogen passed through the cell for ten minutes. During flushing the exit port (2) was blocked for short periods to allow gas build up to occur and cause turbulence within the cell. The exit port (2) was sealed first, followed by the entry port (1). The gas composition was analysed initially and at 24 hour intervals, using syringe extraction and gas chromatography. From these results the oxygen permeation was calculated.

The results of the tests are provided at Table 3.

TABLE 3

| | Oxygen Ingress (ml/day) | | | | | | |
|---|---|---|---|---|---|---|---|
| Blank cell | Day 1 | Day 2 | Day 3 | Day 6 | Day 7 | Day 8 | Day 9 |
| | 0.00 | 0.00 | 0.00 | 0.07 | 0.07 | 0.09 | 0.14 |

| | Oxygen Ingress (ml/day) | | | |
|---|---|---|---|---|
| 26 mm diameter wad (low density) | Day 1 | Day 2 | Day 3 | Day 6 |
| Untreated | | | | |
| Single coated (40H @ 2.3%) | 110 | | | |
| Single coated (P20 @ 2.5% | 220 | | | |
| Single coated (x300 @ 2.5% | 220 | | | |
| Silicone coated cork | 0.7 | 0.7 | 0.7 | 0.7 |
| Paraffin coated cork | 1.1 | 1.1 | 1.1 | 1.1 |

| | Oxygen Ingress (ml/day) | | | | | |
|---|---|---|---|---|---|---|
| 18 mm diameter wad | Day 1 | Day 2 | Day 3 | Day 6 | Day 8 | Day |
| Foamed PVC composite, wax coating (particulated 0.35 g/cm$^3$ wool felt) | 0.22<br>3.70 | 0.11<br>4.20 | 0.22<br>5.20 | 0.11<br>3.50 | 0.10<br>3.40 | 0.10<br>3.20 |
| PVC plasticiser low density, wax coating | 0.22<br>2.00 | 0.11<br>2.20 | 0.13<br>2.90 | 0.09<br>2.10 | 0.08<br>2.10 | 0.09<br>2.10 |
| Silicone coated cork | 0.11 | 0.22 | 0.22 | 0.22 | 0.19 | 0.17 |
| Paraffin coated cork | 0.00 | 0.11 | 0.11 | 0.06 | 0.07 | 0.07 |
| Silicone coated cork | 0.7 | 0.7 | 0.7 | 0.7 | | |

TABLE 3-continued

| Paraffin coated cork | 1.1 | 1.1 | 1.1 | 1.1 | |
|---|---|---|---|---|---|
| | Oxygen Ingress (ml/day) | | | | |
| 18 mm diameter wad | Day 1 | Day 2 | Day 5 | Day 6 | Day 7 |
| PVC plasticiser, low density | 2.48 | 1.74 | 1.92 | 0.48 | 0.41 |
| no wax | 3.30 | 2.39 | 2.42 | 0.36 | 0.03 |
| PVG foam, low density wax | 0.37 | 0.26 | 0.48 | 0.22 | 0.22 |
| coating | 0.22 | 0.06 | 0.02 | 0.03 | 0.06 |
| PVG plasticiser, high | | 0.11 | 0.05 | 0.03 | 0.00 |
| density wad | | 0.06 | 0.05 | 0.03 | 0.00 |

| | Oxygen Ingress (ml/day) | | | |
|---|---|---|---|---|
| 18 mm diameter wad ($0.35\ g/cm^3$) | Day 1 | Day 2 | Day 5 | Day 6 |
| Double coated (360D @ | 0.15 | 0.06 | 0.15 | 0.15 |
| 50% solids) low density | 2.53 | 2.42 | 4.51 | 0.72 |
| Thermoformed, low density | 14.7 | 9.02 | 1.20 | 0.49 |
| | 1 | | | |

Low density = $0.35\ g/cm^3$

EXAMPLE 46

Extraction strength tests on various closures

Tests were carried out to determine the force required to remove various closures from the bottle.

The procedure was as per ISO 9729:1991(E), with the exception that a commercially available corkscrew was used rather than machining the standard corkscrew. The storage conditions varied from one day to eight days with and without wine simulant (12% v/v ethanol in a saturated potassium bitartrate solution). The Results are shown at Tables 4 and 5.

TABLE 4

| Pull out tests (24 hours exposure to wine simulant | | |
|---|---|---|
| Sample | Force(N) | Comments |
| Untreated | no result | Wad wet, push through |
| | no result | Wad wet, push through |
| | no result | Wed wet, push through |
| Thermoformed with SURLYN | 107.1 | Wad was above neck of bottle |
| | 19.6 | Wed turned iu bottle, thus corkscrew did not penetrate through the wed |
| | 19.8 | Wad was wet, above bottle neck and tt turned in the bottle, plastic on wed torn |
| Single wax coated @ 110° C. | 39.2 | Wad wet, wax splitting |
| | 9.8 | Wad wet, wax splitting |
| | no result | Push through |
| Two piece wad | no result | Wad separated after being pushed through |
| | no result | |
| | no result | |
| Double coated (350D @ 50% solids | 245 | Wad above bottle neck 380D changed to white colour were in contact with alcohol |
| | 284.2 | Wad above bottle neck, 360D changed to white colour were in contact with alcohol |
| | 58.8 | Wad above bottle neck 350D changed to white colour were in contact wlth alcohol |
| 19 mm low density ($0.35\ g/cm^3$ nominal) | | |
| PVC plasticizer in 21 mm | no result | Push through |
| cylinder | no result | Push through |
| 19 mm high density ($0.45\ g/cm^3$ nominal) | | |
| PVC foam in 21 mm cylinder | 44 | |
| | 157 | Bottom of wad damaged, slight absorption of blue dye on wad |
| PVC plastisol in 21 mm cylinder | 370 | Bottom of wad split, some blue dye absorbed |
| 18 mm low density ($0.35\ g/cm^3$ nominal) | | |
| Foam PVC wax coated | 20 | Wax lifted from wad, no wax left in bottle neck, wad turned in bottle |
| PVC plasticiser wax coated | 98 | Wax on wad lifting, wax left in bottle neck |

TABLE 4-continued

| Pull out tests (24 hours exposure to wine simulant | | |
|---|---|---|
| Sample | Force(N) | Comments |
| | 58.8 | Wax on wad lifting, wax left in bottle neck |
| PVC plasticiser in 21 mm cylinder | 98.8 | Wad stained on the side with blue dye bottom |
| | 197.5 | puckered |
| | | Bottom puckered |
| 18 mm high density (0.45 g/cm$^3$) | | |
| PVC plastisol | 171.5 | WAd picked up some wax, possibly form corking |
| | 107.8 | machine |
| | 58.8 | Push through. Wad had picked up wax possibly from corker |
| | | Wad turned in bottle, wax remained on wad however wax was lifting |
| Single wax coated @ 160° C. | No result | Push through |
| | No result | |
| Double wax coated @ 160° C. | No result | Push through. Wad had dropped in bottle neck |
| | No result | Push through, very little wax remained on wad |
| 17 mm high density (0.45/cm$^3$) | | |
| PPVC plasticizer wax coated | 95 | Wax remained on wad, no wax on bottle, wad 10 mm above bottle neck |
| | 39.2 | Wax remained on wad |
| Natural cork | | |
| Paraffin coated | 297.9 | |
| | 188.2 | |
| | 282.2 | |
| Silicon coated | 172.3 | |
| | 235.2 | |
| | 164.6 | |

TABLE 5

| Pullout tests (controls of corks and untreated wads with no simulant) | | |
|---|---|---|
| Sample | Force (N) | Comments |
| Pullout performed after 24 hours | | |
| 0.35 nominal density | 270 | |
| | 240 | |
| | 230 | |
| 0.45 nominal density | Zero | Pushed in. The harder wad requires greater effort to engage thread of corkscrew. |
| Cork Parrafin coated | 150 | |
| | 150 | |
| | 160 | |
| Cork Silicon coated | 130 | |
| | 220 | |
| | 30 | |
| | 28 | |
| Pullout performed after 7 days | | |
| Cork Paraffin coated | 290 | |
| | 270 | |
| | 280 | |
| | 170 | |
| | 210 | |
| | 230 | |
| Cork Silicone coated | 100 | |
| | 120 | |
| | 125 | |
| | 130 | |
| | 130 | |
| | 120 | |

EXAMPLE 47

Liquid Leakage Storage Tests

Liquid leakage with various wool felt-based closure constructions were assessed by weighing the sealed bottle containing the wine simulant at 24 hour intervals. The results are provided at Table 6.

TABLE 6

| STORAGE TEST | | | | | | |
|---|---|---|---|---|---|---|
| | Water loss [g] | | | | | |
| | 1 days | 2 days | 3 days | 4 days | 5 days | 6 days |
| Low Density (0.35 g/cm$^3$) 22 mm wad | | | | | | |
| Untreated | 9.5 | 0.9 | 2.0 | 1.4 | 0.3 | 2.2 |
| | 7.9 | 0.6 | 1.9 | 1.5 | 3.3 | 2.0 |
| | 8.7 | 0.7 | 1.9 | 1.7 | 3.6 | 2.0 |
| Thermoformed | +0.1 | 0.0 | 0.0 | 0.0 | 0.0 | 0.0 |
| with SUFLYN | 4.9 | 0.3 | 1.2 | 0.5 | 1.3 | 1.7 |
| | 3.6 | 0.7 | 1.3 | 1.5 | 3.8 | 2.2 |
| Single wax | 3.5 | 0.0 | 2.2 | 0.4 | 1.1 | 1.5 |
| coated @ | 5.4 | 0.9 | 1.8 | 1.6 | 3.7 | 2.1 |
| 110° C. | 5.1 | 0.7 | 1.7 | 1.8 | 4.2 | 2.4 |
| Two piece wad | 6.3 | 0.7 | 1.8 | 1.7 | 4.1 | 2.0 |
| | 6.2 | 0.6 | 1.6 | 1.4 | 3.1 | 1.9 |
| | 7.7 | 0.7 | 1.8 | 1.6 | 3.6 | 2.3 |
| Double coated | +0.3 | +0.1 | 0.0 | 0.1 | 0.0 | 0.0 |
| (360D @ | +0.3 | 0.0 | +0.1 | 0.0 | 0.1 | 0.0 |
| 50% solids) | 4.4 | 0.3 | 0.5 | 0.8 | 2.4 | 0.2 |
| High density 18 mm wad coated with PVC plasticiser | | | | | | |

TABLE 6-continued

| | STORAGE TEST | | | | | |
|---|---|---|---|---|---|---|
| | Water loss [g] | | | | | |
| | 1 days | 2 days | 3 days | 4 days | 5 days | 6 days |
| No wax coating | 0.0 | 0.0 | +0.1 | | | |
| | 0.0 | 0.0 | 0.0 | | | |
| | 0.0 | 0.0 | 0.0 | | | |
| Single wax | 0.0 | 0.0 | 0.0 | | | |
| coated @ | 0.0 | 0.0 | 0.0 | | | |
| 160° C. | | | | | | |
| Double wax | 0.0 | 1.0 | 1.6 | | | |
| coated @ | 0.3 | 0.1 | 0.5 | | | |
| 160° C. | | | | | | |

Note:
high density wads are 0.45 g/ml

EXAMPLE 48

Evaluation of Properties of Wood Felt-PVC Plastisol Closures Against ISO Standards for Cork

EXPERIMENTAL

Six of the Wool felt-PVC plastisol closures described in Example 1 (approximately 33×20 mm) were inserted into 750 ml bottles which had previously been filled with 10% aqueous ethanol solution, sufficient to allow an ullage distance of 15 mm from the level of the solution and the underside of the closure. The force required to remove the cork from the bottles (extractive force) was determined after a period of eight days, using a Mecmesin AGF1000 digital force gauge.

The method used was identical with that specified in ISO 9727, Section 7.6.1, International Organisation for Standardisation (ISO 9729: Cylindrical stoppers of natural cork—physical tests—reference methods, Geneva: ISO; 1991) except that bottles with Stein type bore were used in place of those with the CETIE type bore profile, as the latter were not available. The corking machine used was of a three jaw design rather than the four jaw design specified.

Absorption

Six of the wool felt-PVC plastisol closures were numbered and weighed, inserted into bottles filled with 10% ethanol solution and stored in a horizontal position for eight days. After this time they were removed, placed on a Whatman No. 4 filter paper for one minute, and then reweighed (the same six closures were used in this test and in the extraction strength test described above).

The method followed is based on ISO 9727, Section 7.8, Stein bore rather than CETIE bore bottles were used, and a three jaw corking machine was used.

Absorption was calculated as follows:

$$\text{Absorption} = \frac{m_f - \text{mi}}{m_f} \times 100\%$$

Where $m_f$=final weight of closure, g $m_i$=initial weight of closure, g

Wine Travel

The Varanda apparatus was used to test the resistance of the closures to wine travel. Closures were inserted into three of each of 18 mm and 19 mm internal diameter acrylic "bottle necks" using a corking machine, which were inverted then filled with dye solution after two hours and attached to the apparatus and tested according to the instructions supplied. The closures were trimmed of excess plastic before insertion. For comparative purposes, natural wine corks (44×24 mm) were also tested. All closures were then examined for wine travel after 10 minutes exposed to pressures of 0.5 bar, 1.0 bar, 1.5 bar, 2.0 bar and 2.5 bar.

RESULTS

Extraction force

Results of extraction force are summarised in Table 7. Extraction force should lie between 200 N and 300 N; the results for five of the six closures tested lie within this range, while the result for one closure was low. It must be noted that these standards relate to corks inserted into bottles with the CETIE type bore, while bottles with a Stein type bore were used in the tests. The slightly greater diameter of the CETIE bore may be expected to result in slightly lower values for extraction force.

Absorption

Results of the absorption tests are also summarised in Table 7. The CTCOR specifications for absorption following the test method described have also been obtained; the absorption for natural corks should be less than 3%, and for agglomerate corks, less than 40%. The results obtained were well below both these specifications.

Wine Travel

Virtually no travel of the dye solution was observed in any of the six closures tested, ever at the maximum test pressure of 2.5 bar. Two of the closures were cut in half lengthwise after testing, and this revealed that the dye had not penetrated the coating. In comparison, considerable travel was observed in the natural wine corks at a pressure of 0.5 bar. It is acknowledged, however, that the behaviour of these corks may not be typical of all corks.

TABLE 7

Results of measurements of extraction force and absorption of wool felt - PVC plastisol closures

| Closure | Extraction Force (N) | Absorption (% w/w) |
|---|---|---|
| 1 | 244 | 0.16 |
| 2 | 281 | 0.15 |
| 3 | 166 | 1.02 |
| 4 | 218 | 0.12 |
| 5 | 299 | 0.16 |
| 6 | 259 | 0.16 |
| mean | 244.5 | 0.295 |

The results indicate that the wool felt-PVC plastisol closures performed well in terms of extraction force, absorption and wine travel. Some closures had slightly low extraction force, compared with available standards. This may be able to be improved upon by increasing the diameter of the closures.

EXAMPLE 49–57

Wool Felt-Polyurethane Closures

All closure examples 49–57 were made using wads of 0.4 g/cm$^3$ wool felt. The felt wads used in the closures were 21.5, 22.0 or 22.5 mm in diameter and 38 or 40 mm in length. The wads were coated and/or capped with the polyurethane 6012A (UniRoyal Chemical Co.), and in some cases undercoated with EVA. Extraction forces and wine travel test results are shown in Table 8.

TABLE 8

| Example | Closure Characteristics | | | | | Extraction | Travel @ |
|---|---|---|---|---|---|---|---|
| No. | $L_M$ | $D_M$ | $D_{MD}$ | $L_{CAP}$ | Coating | Force(N) | 2 bar |
| 49 | 43 | 21.5 | 21.0 | 0 | PU | 289 | 87 |
| 50 | 43 | 22.0 | 21.5 | 0 | PU | 464 | 40 |
| 51 | 43 | 21.5 | 21.0 | 2.5 | PU | 342 | 75 |
| 52 | 38 | 21.5 | 21.0 | 2.5 | PU | 294 | 0 |
| 53 | 43 | 22.0 | 21.5 | 2.5 | PU | 399 | 0 |
| 54 | 43 | 22.5 | 22.0 | 2.5 | PU | 553 | 0 |
| 55 | 43 | 22.0 | 21.5 | 1.0 | EVA/FU | 264 | 24 |
| 56 | 43 | 22.0 | 21.5 | 2.5 | EVA/PU | 315 | 0 |
| 57 | 43 | 22.0 | 21.5 | 4.0 | EVA/PU | 392 | 0 |

PU = polyurethane 6012A
EVA = ethyl vinyl acetate (undercoat)
$L_M$ = mass length (mm)
$D_M$ = mass diameter (mm)
$D_{MD}$ = mould diameter (mm)
$L_{CAP}$ = length of composite end cap (mm)

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A closure for a container having an opening, consisting of:

(i) at least one resilient masses of fibers selected form synthetic fibers, natural fibers and mixtures thereof, said at least one resilient mass of fibers having a density of 0.15 to 2.00 g/cm$^3$ and having interlocked structure; and (ii) one or more additives, wherein the additives function to coat, impregnate or coat and impregnate at least a portion of the resilient mass of fibers, wherein the at least resilient mass and on or more additives form the closure, the closure being essentially impermeable to liquids and gases and, further, being sized and having a density to enable the closure to be sealingly inserted into the opening of said container.

2. A closure according to claim 1 wherein the resilient mass of fibers has a density of 0.18 to 0.95 g/cm$^3$.

3. A closure according to claim 2 wherein the resilient mass of fibers has a density of 0.4 to 0.8 g/cm$^3$.

4. A closure according to claim 2 wherein the resilient mass of fibers is formed by a process selected from felting, needle-punching, weaving, knitting and combinations thereof.

5. A closure according to claim 4 wherein the natural fibers are sheep wool fibers.

6. A closure according to claim 5 wherein the natural fibers are sheep wool fibers.

7. A closure according to claim 6 wherein the additive(s) function to coat at least a portion of the resilient mass(es) of fibers.

8. A closure according to claim 7 wherein the additive(s) are selected from the group consisting of polyethylene dispersion, modified polyethylene dispersion and gels of polymers such as ethylene vinylacetate copolymer (EVA), solutions and dispersions of poly(vinylidene chloride) (PVC's) and its copolymer, polyurethanes, acrylic latexes, lacquers and dispersions, thermoformed films, paraffins, waxes and silicones.

9. A closure according to claim 5 wherein the resilient mass of fibers consists of a mixture of synthetic fibers and sheep wool fibers.

10. A closure according to claim 9 wherein the additive(s) function to coat at least a portion of the resilient mass(es) of fibers.

11. A closure according to claim 10 wherein the additive(s) are selected from the group consisting of polyethylene dispersions, modified polyethylene dispersions and gels of polymers such as ethylene vinylacetate copolymer (EVA), solutions and dispersion of poly(vinylidene chloride (PVC's) and its copolymer, polyurethanes, acrylic latexes, lacquers and dispersion, thermoformed films, paraffins, waxes and silicones.

12. A closure according to claim 6 wherein the additive(s) is incorporated into the resilient mass of fibers such that the fibers of at least a portion of the resilient mass of fibers are impregnated by the additive(s).

13. A closure according to claim 12 wherein the additive(s) are selected from the group consisting of polyethylene dispersion, modified polyethylene dispersions and gels of polymers such as ethylene vinylacetate copolymer (EVA), solutions and dispersions of poly(vinylidene chloride)(PVC) and its copolymers, polyurethanes, acrylic latexes, lacquers and dispersions, paraffins, waxes and silicones.

14. A closure according to claim 9 wherein the additive(s) is incorporated in to the resilient mass of fibers such that the fibers of at least a portion of the resilient mass of fibers are impregnated by the additive(s).

15. A closures according to claim 14, wherein the additive(s) are selected from the group consisting of polyethylene dispersions, modified polyethylene dispersions and gels of polymers such as ethylene vinylacetate copolymer (EVA), solutions and dispersions of poly(vinylidene chloride (PVC) and its copolymers, polyurethanes, acrylic latexes, lacquers and dispersions, paraffins, waxes and silicones.

16. A closures according to claim 1 wherein the additive(s) comprises 0.01 to 70% (by weight) of the closure.

17. A closure according to claim 1 wherein the additive(s) comprises 0.01 to 30% (by weight) of the closure.

18. A closure according to claim 6 wherein the resilient mass of fibers has a solid, essentially uniform cross-section throughout.

19. A closure according to claim 9 wherein the resilient mass of fibers has a solid, essentially uniform cross-section throughout.

20. A closure according to claim 3 wherein the resilient mass of fibers is formed by a process selected from felting, needle-punching, weaving, knitting and combinations thereof.

* * * * *

UNITED STATES PATENT AND TRADEMARK OFFICE

CERTIFICATE OF CORRECTION

PATENT NO. : 6,022,816
DATED : February 8, 2000
INVENTOR(S) : George Galloway Dewar It is certified that error appears in the above-identified patent and that said Letters Patent is hereby corrected as shown below:

Column 5,
Line 50, change "Wood" to -- Wool --;

Column 6,
Line 12, change "11.5 wt%" to -- 7.5 wt% --;
Line 25, change "locating" to -- coating --;

Column 7,
Line 3, change "55 m" to -- 55 mm --;
Line 38, change "(1)" to -- (11) --;
Line 61, change "concave" to -- concaved --;

Column 8,
Line 6, change "generating" to -- generated --;
Line 29, change "lines" to -- line --;
Line 44, change "was" to -- wad --;

Column 10,
Line 27, change "woo" to -- wool --;

Column 18,
Line 25, change "9729:1991(E)" to -- 9727:1991(E) --;

Column 21,
Line 37, change "9729" to -- 9727 --;

Column 22,
Line 8, change "exposed" to -- exposure --;
Line 31, change "ever" to -- even --;

Column 23, claim 1,
Line 32, change "form" to -- from --;
Line 35, change "having interlocked" to -- having an interlocked --;
Lines 38-39, change "at least resilient mass" to -- at least one resilient mass --;
Line 39, change "on" to -- one --;

Column 23, claim 6,
Line 55, change "claim 5" to -- claim 1 --;

Column 24, claim 15,
Line 37, change "closures" to -- closure --;

UNITED STATES PATENT AND TRADEMARK OFFICE

CERTIFICATE OF CORRECTION

PATENT NO. : 6,022,816
DATED : February 8, 2000
INVENTOR(S) : George Galloway Dewar It is certified that error appears in the above-identified patent and that said Letters Patent is hereby corrected as shown below:

Column 24, claim 16,
Line 45, change "closures" to -- closure --.

Columns 9 and 10,
Table 1, in the heading of Table 1, change the title of the 5th column from the left from "Flet diameter" to -- Felt diameter --;
Example 6, under "Felt diameter (mm), change "26" to -- 28 --;
Example 8, under "FDA Compliance", change "176, 176" to -- 176,170 --;

Columns 11 and 12, Table 1,
Example 10, under "Felt diameter", change "25 mm" to -- 28 mm --;
Example 11, under "Latex Name", change Michelman 66725" to
-- Michelman 68725 --;
Example 13, under "Type", change "polyvinylidene" to -- polyvinylidene chloride --;
Example 18, under "1-day Dry Closure Pull Out Force (kg)", insert -- 14 --below "10";
Example 19, under "1-day Dry Closure Pull Out Force (kg)", insert -- 18 --below "17";
under "2-day Dry Closure Pull Out Force (kg)", insert -- 16 --below "22";
Example 21, under "Felt diameter (mm), change "26" to -- 28 --;

Columns 13 and 14, Table 1,
Example 25, under "Felt diameter (mm), change "26" to -- 28 --.

Column 15, Table 2,
Example 40, under "Post Compression Length (mm)", insert -- 33 --.

Column 16,
Table 3, in the row heading, change "26 mm diameter wad (low density)" to -- 28 mm diameter wad (low density) --.

Column 17,
Table 3, under the heading "18 mm diameter wad", in the row "PVC plasticiser, low density no was", change "0.03" ml/day to -- 0.93 -- ml/day.

Columns 17 and 18,
Table 4, in the column titled "Sample", above the first sample titled "Untreated" insert -- 22 m low density (0.35 g/cm$^3$ nominal) --;

Table 4,
In its column titled "Comments", in lines 3, 5 and 6, change the three occurrences of "Wed" or "wed" to -- Wad -- or -- wad -- respectively;

UNITED STATES PATENT AND TRADEMARK OFFICE

CERTIFICATE OF CORRECTION

PATENT NO. : 6,022,816 
DATED : February 8, 2000
INVENTOR(S) : George Galloway Dewar
INVENTOR(S) :

It is certified that error appears in the above-identified patent and that said Letters Patent is hereby corrected as shown below:

Table 4,
In the "Thermoformed with Surlyn" sample, change the Pull out tests, Force (N) from "107.1" to -- 107.8 -- and "19.8" to -- 19.6 --;

Columns 17 and 18,
Table 4, change the title of the fifth sample tested from Double coated 350D @ 50% solids" to -- Double coated 360D @ 50% solids --;
in the fifth sample, under comments corresponding to a Force (W) of "245" and "58.8", change the comments to -- Wad above bottle neck 360D changed to white colour were in contact with alcohol --;

Columns 19 and 20,
Table 4, under the sample "18 mm low density (PVC listed plasticiser in 21 mm cylinder", change the third listed Force (N) from "197.5" to -- 197.6 --;
in the sample titled "18 mm high density (PVC plasticol)", in the comment column, change "WAd" to -- Wad --;
in the sample titled "17 mm high density (PPVC plasticizer wax coated", change the Force (N) from "95" to -- 96 --;
in the sample titled "Natural cork Silicon coated" change the first listed Force (N) from "172.3" to -- 172.5 --.

Column 20,
Table 6, in the left-most column, change the word "SUFLYN" to -- SURLYN --.

Column 23, Table 8,
Example 49, under "Travel @ 2 bar", change "87" to -- 67 --;
Example 55, under "Coating", change "EVA/FU" to -- EVA/PU --;
Example 56, under "Force (N), change "315" to -- 316 --.

Signed and Sealed this

Fifth Day of March, 2002

*Attest:*

*Attesting Officer*

JAMES E. ROGAN
*Director of the United States Patent and Trademark Office*